US009168196B2

(12) United States Patent
Dagan

(10) Patent No.: US 9,168,196 B2
(45) Date of Patent: Oct. 27, 2015

(54) SELF-MASSAGE DEVICE

(76) Inventor: Gideon Dagan, Los Angeles, CA (US)

( * ) Notice: Subject to any disclaimer, the term of this patent is extended or adjusted under 35 U.S.C. 154(b) by 651 days.

(21) Appl. No.: 13/484,144

(22) Filed: May 30, 2012

(65) Prior Publication Data

US 2013/0066245 A1 Mar. 14, 2013

Related U.S. Application Data

(60) Provisional application No. 61/532,472, filed on Sep. 8, 2011, provisional application No. 61/533,109, filed on Sep. 9, 2011.

(51) Int. Cl.

| | |
|---|---|
| ***A61H 15/00*** | (2006.01) |
| ***A61H 7/00*** | (2006.01) |
| ***A61H 39/04*** | (2006.01) |

(52) U.S. Cl.

CPC ..... *A61H 7/003* (2013.01); *A61H 15/0092* (2013.01); *A61H 39/04* (2013.01); *A61H 2015/0064* (2013.01); *A61H 2201/0107* (2013.01); *A61H 2201/0126* (2013.01); *A61H 2201/0161* (2013.01); *A61H 2201/1284* (2013.01); *A61H 2201/1685* (2013.01); *A61H 2205/04* (2013.01); *A61H 2205/062* (2013.01); *A61H 2205/081* (2013.01)

(58) Field of Classification Search

CPC ... A61H 7/003; A61H 15/0092; A61H 39/04; A61H 2015/0064; A61H 2201/0107; A61H 2201/0161; A61H 2201/1284; A61H 2201/1685; A61H 2201/0126; A61H 2205/081; A61H 2205/04; A61H 2205/062

USPC ..... 601/15, 112, 113, 114, 118, 119, 122, 601/123, 125, 134, 135, 136, 137, 138; 606/204; D24/211, 214

See application file for complete search history.

(56) References Cited

U.S. PATENT DOCUMENTS

| | | | | | |
|---|---|---|---|---|---|
| 3,750,654 | A | | 8/1973 | Shiu | |
| 3,856,002 | A | * | 12/1974 | Matsumoto | 601/137 |
| 4,266,536 | A | | 5/1981 | Casares | |
| 4,411,421 | A | * | 10/1983 | Hershberger | 601/118 |
| 4,718,409 | A | | 1/1988 | Gershov et al. | |
| 4,798,198 | A | | 1/1989 | Wright | |
| D317,204 | S | * | 5/1991 | Henneseey | D24/211 |
| 5,530,983 | A | | 7/1996 | Maltese | |
| 5,560,746 | A | | 10/1996 | Willow | |
| 5,730,708 | A | | 3/1998 | Spratt | |
| D402,764 | S | | 12/1998 | Chatfield | |
| D403,431 | S | | 12/1998 | Gladieux, Jr. | |
| 5,848,980 | A | | 12/1998 | Demerais | |
| 5,868,689 | A | | 2/1999 | Faroky et al. | |
| 6,261,251 | B1 | | 7/2001 | Meyers | |

(Continued)

*Primary Examiner* — Quang D Thanh

(74) *Attorney, Agent, or Firm* — Robert A. Seldon

(57) ABSTRACT

A massage device comprises a body having a body-contacting head adjacent one end and a handle adjacent the other end, the body shaped to permit the user to reach the back of his/her body with the head when the handle is at the user's front or side; and having a rest pivot extending from the body and terminating at a distal end in a support-contacting face, the rest pivot being positioned so that when the device is between a support surface and the user with the head in contact with the user's body and the handle positioned for contact by the user's hand, (a) the user's bodyweight stabilizes the rest pivot against sliding movement on the support and (b) any pivoting force about the rest pivot applied by the user's hand to the handle is substantially less than the force exerted against the user's body by the head.

26 Claims, 5 Drawing Sheets

(56) References Cited

U.S. PATENT DOCUMENTS

| | | | | |
|---|---|---|---|---|
| D461,009 | S | 7/2002 | Viner | |
| 6,988,997 | B2 | 1/2006 | Stultz | |
| 7,122,015 | B2 | 10/2006 | Luettgen et al. | |
| D539,915 | S | 4/2007 | Timmer | |
| 2002/0193715 | A1 | 12/2002 | Slack | |
| 2005/0015028 | A1* | 1/2005 | Luettgen et al. | 601/95 |
| 2007/0287938 | A1 | 12/2007 | Shields | |
| 2011/0087140 | A1 | 4/2011 | Lee | |
| 2011/0224588 | A1* | 9/2011 | Grippo | 601/135 |

* cited by examiner

SELF-MASSAGE DEVICE

FIELD OF THE INVENTION

This invention is directed to a massage device which acts upon a user's body by moving or massaging a portion of the body to produce a therapeutic effect.

BACKGROUND

This massage apparatus herein is intended to aid in a self-massage of regions of the body which are nearly or completely inaccessible using hands alone by applying pressure to treat sore muscles and trigger points on hard-to-reach areas of the back, neck and shoulders without tiring upper body muscles.

Devices commonly used in self-massaging the back tend to be held in the user's hands and pulled to the place of tension. Examples of such devices are trigger point massage devices such as the "AccuMassager Trigger Point Massager" offered by Body Back Company at www.bodyback.com, the "Backnobber Massager 2" offered by The Pressure Positive at www.backnobber-store.com, the "SoloMAX self-massage tool" offered by Kelly Kinetics, the "Thera Cane" offered by Thera Cane at www.theracane.com, and the "Body Back Buddy Jr. Trigger Point Travel Massager", the "Body Back Buddy Trigger Point Massager", and the "Body Back Mini Trigger Point Travel Massager" offered by Body Back at www.bodyback.com.

The massage devices to which the present invention is directed require the user to hold the device over his/her shoulder in order to direct the body-contacting tip of the device to the point of massage, and to then moving the device by pushing, pulling and otherwise manipulating it with his/her arms and shoulders in order to apply pressure to the problem point. Devices of this type are ineffective because the muscles they are designed to help relax are actually involved in the massage process. Also, the arm strength of some users is limited, and they cannot easily and/or comfortably reach the problem spot(s) with the massage device and/or use the device effectively owing to an inability to apply an effective degree of force to the problem spot.

SUMMARY

This invention herein is directed to a massage device that allows the user to relax the back and shoulders while, at the same time, applying sufficient and effective force to the massage point. More specifically, a massage device constructed in accordance with the invention permits the user to apply at least a substantial portion of his/her body weight to the massage point on their back, neck and shoulders. Little arm strength, and the use of only one hand or arm, is required and there is no strain on the upper body.

Briefly, the massage device comprises a main body having a body-contacting head point adjacent one end, a manually grippable handle region adjacent the other end, and a rest pivot extending from the main body that terminates at a distal end in a support-contacting surface for contacting a wall or other supporting structure. The main body is shaped to permit the user to reach the back of his/her body with the head end when the handle region is at the user's front or side. The rest pivot is positioned with respect to the head point so that at least some of a user's bodyweight is applied to the rest pivot when the massage device is sandwiched between the support surface and user, with the head point in contact with the user's body; the rest pivot is positioned on the massage device so that bodyweight applied to the rest pivot generally stabilizes the rest pivot against sliding movement on the support. The rest pivot's position on the massage device provides mechanical advantage whereby any pivoting force applied to the handle region of the main body about the rest pivot is substantially less than the force exerted against the user's body by the head point.

Other details and features of the invention will become apparent from the following detailed description, including the annexed drawings, which discloses a preferred embodiment of the invention.

DETAILED DESCRIPTION OF THE PREFERRED EMBODIMENT

As illustrated in FIGS. 1 and 2A-C, a preferred embodiment of the massage device comprises a generally "S"-shaped main body 1 having a body-contacting head point 4 at one end (hereinafter referred to as the "head end"), and a handle region adjacent the other end 5 (hereinafter, the "handle end"). The main body may alternatively be generally "J"-shaped, lacking the curve adjacent said other end 5 and instead extending generally linearly to said other end, without departing from the scope of the invention. In either shape, the main body is shaped to permit the user to reach the back of his body with the head end when the handle region is at the user's front or side.

Figure 3:
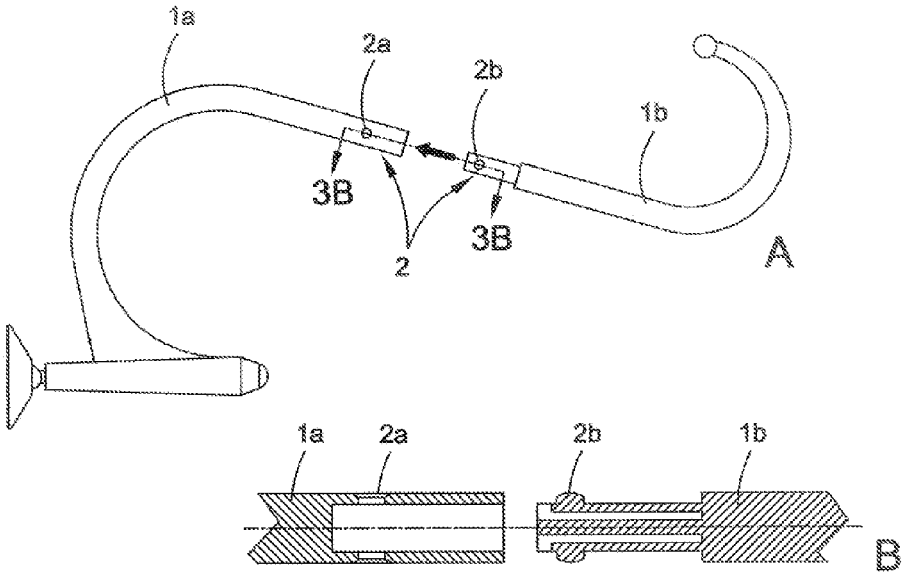
FIG. 3A is a right side elevation view in schematic of a variation of the preferred massage device of FIG. 1.
FIG. 3B is an enlarged fragmentary sectional view taken along line 3B-3B in FIG. 3A.

The main body 1 can formed from a single integral piece of plastic, wood or metal or can be formed from multiple reversibly detachable parts. The preferred main body 1 is bifurcated into two body segments 1*a*, 1*b* that are coupled together by a locking mechanism 2 that allows the main body to be taken apart for convenient storage or travel and thereafter securely reassembled. Examples of locking mechanisms are illustrated in FIGS. 3*a-b*, wherein a leading end portion of body segment 1*b* fits within a leading tubular end portion of body portion 1*a*. A cantilevered button 2*b* is carried by the end portion 1*b* and is deflected inward by the interior walls of the leading portion of body segment 1*a* as the two body segments are fit together. The cantilever provides a spring bias that causes the button 2*b* to emerge from a hole 2*a* in the tubular portion of body segment 1*a* to thereby releasably lock the two segments together much like the releasably securing mechanism commonly found in the poles of beach umbrellas. Manually depressing the button down into the hole permits the two body segments to be separated as with such beach umbrella poles. A single button can be provided, or two (preferably circumferentially opposite) buttons can be used with respective mating holes as illustrated in FIG. 3*b*. Other known configurations of spring-loaded buttons and mating holes can be employed, or mating screw threads can be provided that permit one body segment to be screwed into and out of the other.

Figure 4:
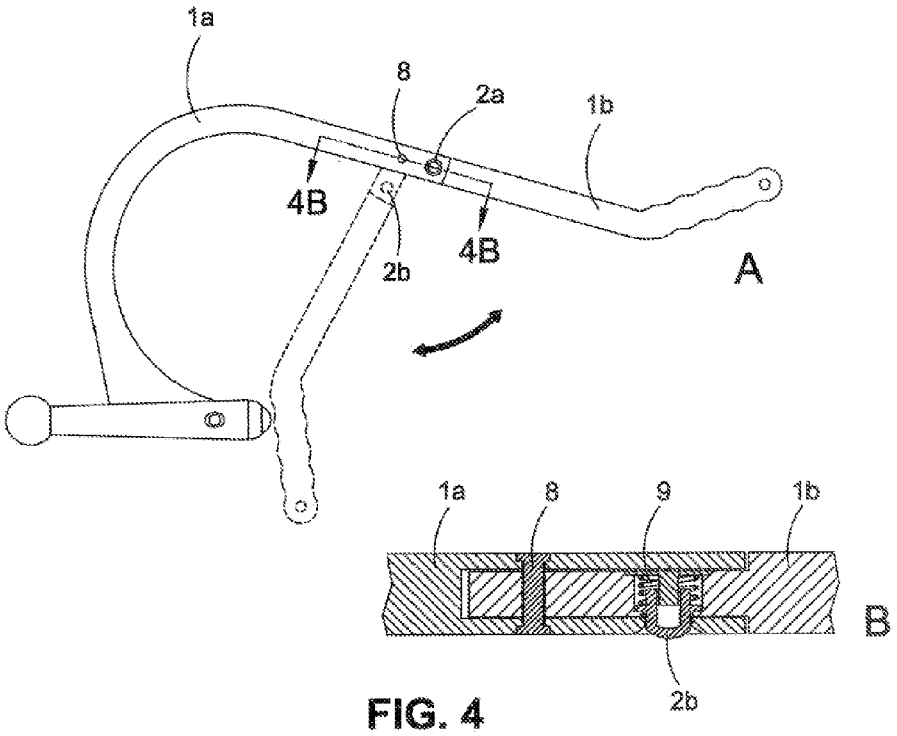
FIG. 4A is a right side elevation view in schematic of another variation of the preferred massage device of FIG. 1.
FIG. 4B is an enlarged fragmentary sectional view taken along line 4B-4B in FIG. 4A.
Figure 5:
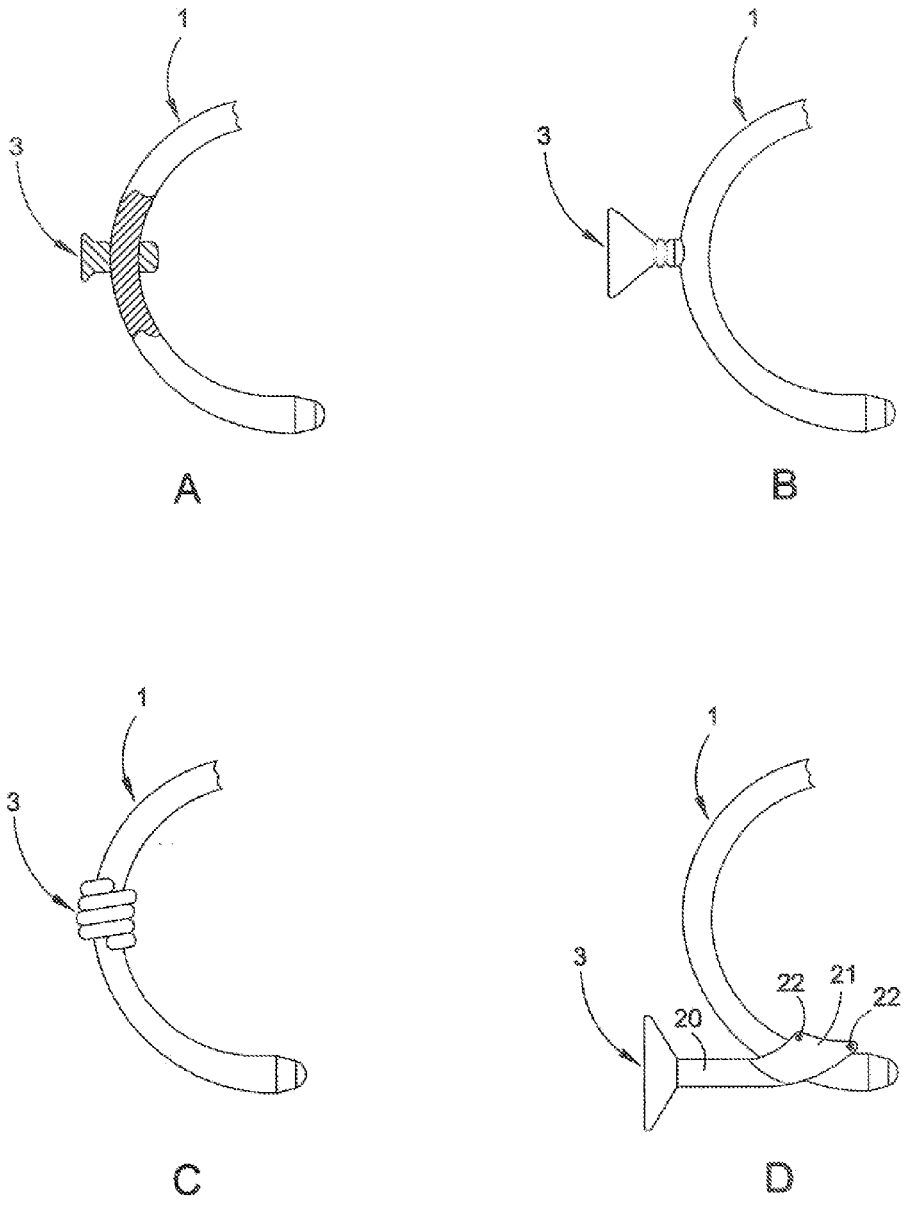
FIG. 5A-D are fragmentary side elevation views showing examples of alternative rest pivot locations and optional rest pivots constructed in accordance with the invention.

An alternative bifurcated configuration for coupling the two body segments together is illustrated in FIGS. 4A-B. Main body segments 1*a* and 1*b* are coupled together for relative rotation about a hinge shaft 8. One of the body segments carries a button that is rotated into alignment with a hole 2*a* in the other body segment to configure the message device for use. A compressed spring 9 biases the button upward through the hole, as most easily seen in FIG. 4B. Depressing the button into the hole permits the body segments to be folded for easier storage or transportation, as illustrated in dotted lines in FIG. 4A. Alternative locking mechanisms such as a mechanical latch or a cantilevered button may be used as well, but are less preferred.

Figure 1:
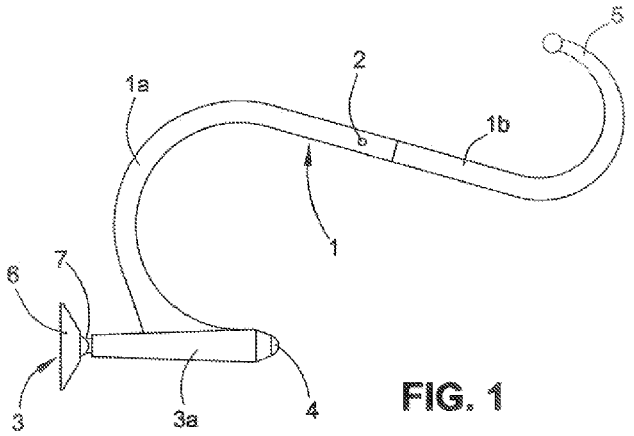
FIG. 1 is a right side elevation view in schematic of a preferred embodiment of a massage device constructed in accordance with the invention.

As best illustrated in FIGS. 1 and 2A-B, the main body 1 is supported against a wall by a rest pivot 3 that allows the body 1 to swivel and turn without slipping off the wall. The preferred rest pivot 3 includes a base 6 having a wall-contacting face with a wall-contacting surface. The base 6 illustrated in FIGS. 1 and 2A-B is generally cup-shaped, with a wall contacting face that can be generally planar or generally concave (i.e., similar to a suction cup's shape). At least the wall-contacting surface of the base 6 is preferably made from a non-abrasive and/or resilient material: for example, latex rubber, plastic, foam, metal and combinations thereof. The illustrated rest pivot further includes an arm 3*a* pivotably coupled to the base by a ball and socket mechanism 7, or other pivot mechanism, to enable the body 1 to swivel and turn with respect to the wall-contacting surface.

When the massage device is sandwiched between a support surface (such as the wall illustrated in FIGS. 2A-C) and the user, with the head point 4 in contact with the user's body, the user's bodyweight can be controllably and adjustably applied against the head point. At the same time, the bodyweight applied to the massage device is applied to the rest pivot to generally stabilize the rest pivot against sliding movement on the support surface. Owing to the mechanical advantage produced by the location of the rest pivot close to the head point's position on the main body, and relatively far from the handle region, a very small degree of pivoting force must be applied by the user against the handle region to exert a deeply penetrating force by the head point 4 against the user's body. By easily locating the head point to its desired position against the body in a tactile manner, leaning into the head point and exerting a small degree of pivoting force, the user can effectively apply deep tissue pressure with a single hand or arm and with minimal body strength so that the user's hand, wrist, arm, shoulder and back muscles are not strained.

A user may alternatively use a chair's back while sitting in the chair, or may use a tree, car, floor or any other suitable surface as a support surface without departing from the scope of the invention.

The rest pivot can be an integral part of the main body 1, or attached to the main body either permanently or detachably. When "integral", it may formed as part of the main body 1 as, for example, a part of a mold used to make the body. Alternatively, it may be relatively permanently affixed to the main body by mechanical or chemical means in a manner rendering it impractical, unlikely or impossible for a user to remove it.

The preferred rest pivot illustrated in FIGS. 1 and 2A-B includes an arm 3*a* that can be formed as an integral or detachable part of the main body 1 and can be either permanently or removably attached to the pivot mechanism 7. Alternatively, the main body 1 may include an arm 3*a* that slides over or into a similar arm extending from the base 6 that is pivotably coupled to the base.

While it is preferred that the pivot arm 3*a* extend from the main body 1 at a position opposite the head point 4 as illustrated by way of example in FIGS. 1 and 2A-B, the rest pivot can alternatively extend from the main body 1 at a position offset from the head point as, for example, illustrated in FIG. 5A-D. The configuration of FIGS. 1 and 2A-B are preferred, however, because the user's weight is thereby transmitted directly to the wall without a leverage force from such an offset being transmitted to the handle region of the main body to thereby increase the mechanical advantage produced. In addition, the rest pivot's position illustrated in FIGS. 1 and 2A-B minimizes the generally tangentially-directed force vector of bodyweight that tends to create a sliding motion against the wall as the handle is manipulated by the user when the rest pivot is offset from that position.

The rest pivot's position can be fixed with respect to the main body 1, as illustrated by way of examples in FIGS. 5A-B, or the rest pivot can be slid into a desired position as illustrated by way of examples in FIGS. 5A, C-D. In FIG. 5C, the rest pivot is formed as a coil of high density foam rubber which can be slid along the body. In FIG. 5D, the rest pivot configuration includes an arm 20 and collar 21 wherein the collar portion can be slid into a desired position and tightened in place via fasteners 22.

Figure 6:
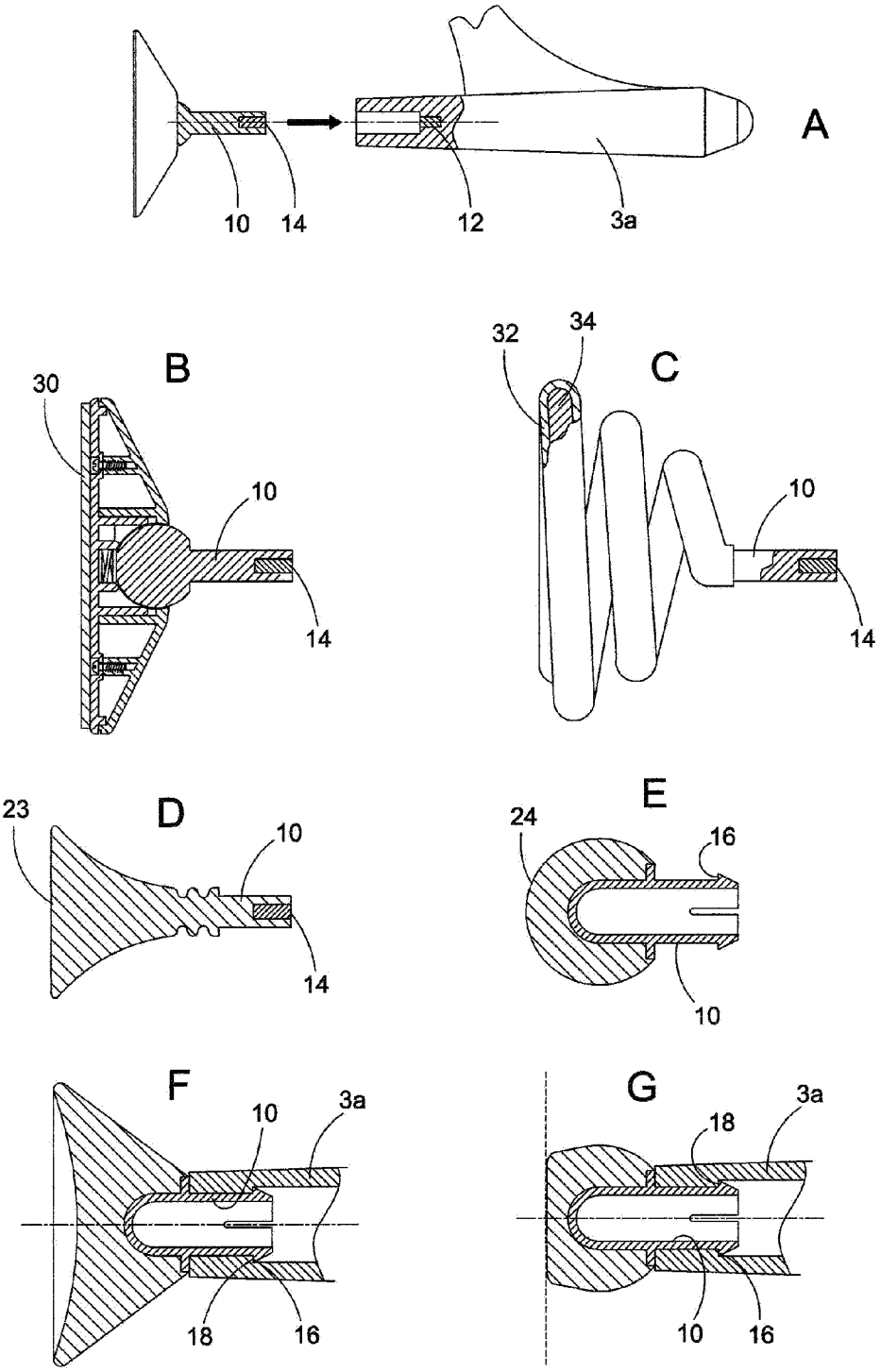
FIG. 6A is a fragmentary side elevation view of an optional rest pivot feature.
FIGS. 6B-G are fragmentary right side elevation views in section showing examples of optional rest pivots constructed in accordance with the invention.

As illustrated in FIGS. 1, 2A-B, and 6B-G, the rest pivot can be any of a number of different configurations so long as it provides a requisite degree of pivoting motion. It may comprise, for example, a cup-shaped base and "ball and socket" arrangement shown by way of example in FIGS. 1, 2A-B and 6B, a springy helical body shown in FIG. 6C, a body of flexible material having a generally flat surface-contacting surface 23 as illustrated in FIG. 6D, a body having a convex or generally spherical surface-contacting face 24 as shown in FIG. 6E which can roll slightly to permit the pivoting motion, a suction cup of flexible material as illustrated in FIG. 6F, or a body of flexible material as shown by way of example in FIG. 6G that is capable of flexing sufficiently to permit pivoting movement of the massage device's main body. An advantage of the configurations shown in FIGS. 6C-G is that the base itself acts as the pivoting mechanism, unlike the configuration shown in FIGS. 1, 2A-B and 6B, so that the ball and socket 7 (FIG. 1) or other mechanical pivot mechanism can be eliminated.

In FIG. 6C, the coiled shape of the base itself provides the requisite degree of pivoting movement. In the configurations of FIGS. 6D, 6F and 6G, the nature of the material allows the body 1 to pivot.

In all cases, the use of a non-abrasive support-contacting surface is preferred, and particularly one fabricated from a non-slip material as a precaution. The material may be applied to a hard plastic material or other material lacking the preferred characteristics, as exemplified by the non-slip material 30 affixed to the support-contacting surface of the pivot housing in FIG. 6B or, alternatively, may be applied as an outer layer to the entire pivot structure as exemplified by exterior layer of non-slip material 32 applied to the a core material 34 of the pivot illustrated in FIG. 6C. In both FIGS. 6B and 6C, the non-slip material may be applied to a hard plastic material serving as the housing in FIG. 6B and the core in FIG. 6C.

The rest pivot can be removably secured to the body, as illustrated by way of example in FIGS. 6A-G if one wishes to provide such a feature as a matter of convenience for the user when storing the device or packing it for travel, or to permit the user to choose among a variety of base configurations can for maximum comfort or effect. As illustrated in FIGS. 6A-G, the base of the rest pivot can be provided with a stem 10 that fits within a generally tubular portion of the arm 3*a*, where it is secured by the force of the user's body pressing against the wall (FIG. 2A). Alternatively, it may be magnetically secured within the arm by the coupling of a magnet 12 in the arm, the base (or its stem) with magnetically-responsive material 14 in the other of the arm and the base (or stem) as illustrated by way of example in FIGS. 6A-D.

The detachable attachment of the rest pivot can alternatively be accomplished by providing the stem 10 and arm 3*a* with mating threads that enable the rest pivot be screwed into the arm and unscrewed therefrom. Other mechanical couplings can be provided that renders the rest pivot releasably secured within the body 1 as well. For example, a locking mechanism similar to locking mechanism 2 (FIGS. 2, 5) can be employed for example. Alternatively, a "bayonet" structure can be used as illustrated in FIG. 6E-G wherein interlocking shoulders 16, 18 of male and female connectors, respectively, are used. The configuration shown in FIGS. 6F and 6G can be structured to permit easy detachment of the rest pivot by, for example, enabling the male connector's shoulders 16 to be inwardly deflected to pass around the female connector's shoulders 18 as the rest pivot is withdrawn from the arm 3*a* by making the male extension resiliently and inwardly deformable by when squeezed by the user.

Figure 7:
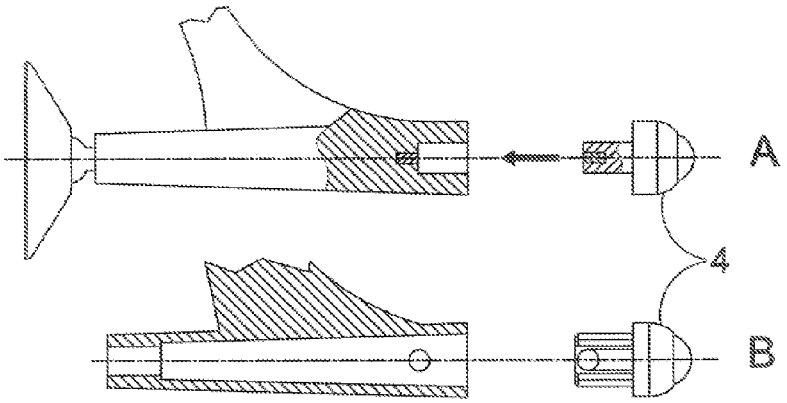
FIGS. 7A-B are fragmentary right side elevation sectional views in schematic illustrating some alternative head points that can be used as part of the preferred message device.
Figure 8:
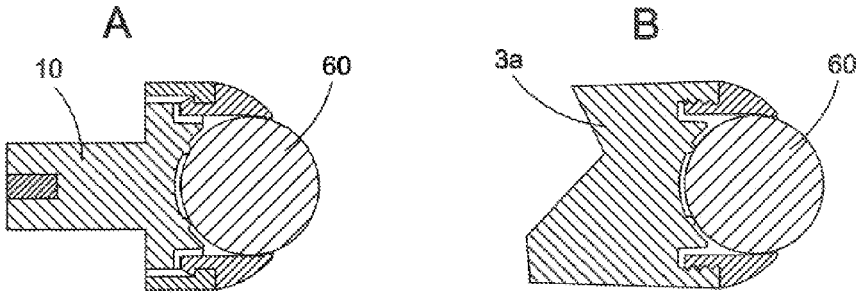
FIG. 8A-B illustrate alternative head points that can be used as part of the preferred message device.

The releasably-securing mechanisms described above can also be used at the head point end of the body to provide detachable and/or interchangeable heads points. Changeable head points permit the device's head point to be used for different applications: e.g., as a scratcher, a lotion-applicator, a wash cloth, a brush, etc. As illustrated in FIGS. 7A-B by way of example, a changeable head point can serve different purposes such as one best for massaging sore muscles and one best for exerting pressure against trigger points. The head-points illustrated in FIGS. 7 A-B and 8A-B include a rolling ball 60 that can be either detachably mounted as illustrated by way of example in FIG. 8A or integrated into the main body at arm 3A as illustrated by way of example in FIG. 8B, to provide a smooth rolling massage of sore and tired tissues with a direct pressure to tight trigger points. Alternatively, the ball may be non-rotating or an integral part of the body.

Figure 2:
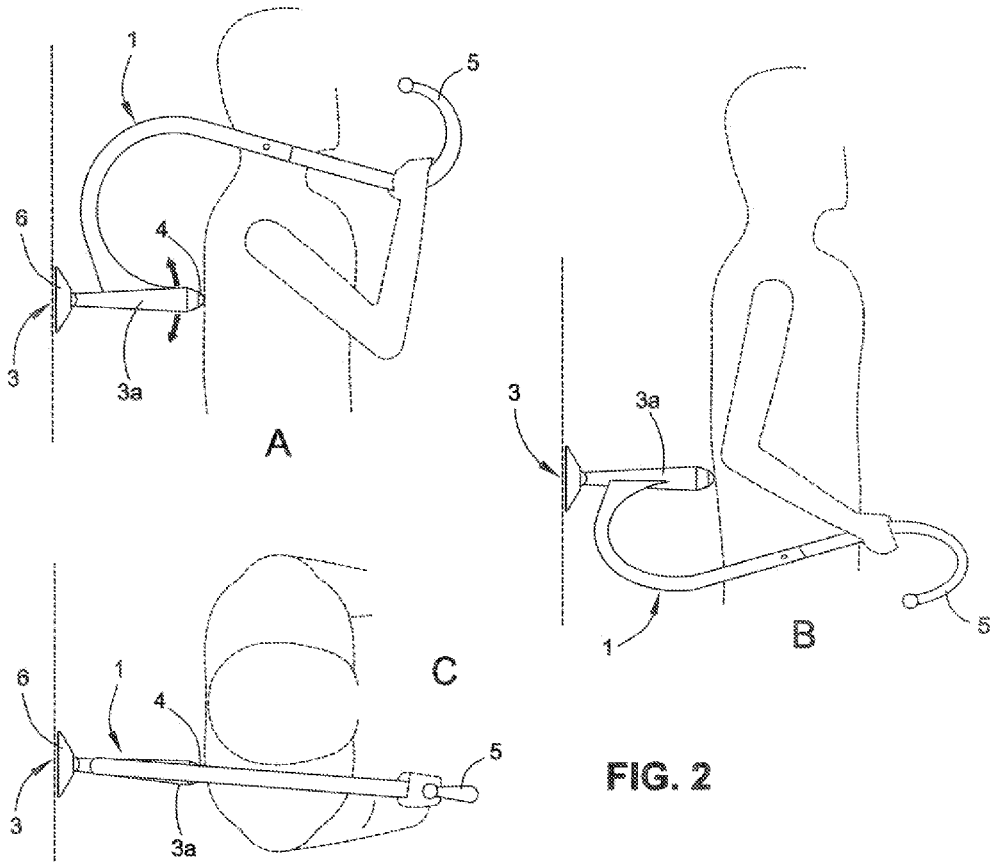
FIGS. 2A and 2B are each a right side elevation view in schematic of the preferred massage device of FIG. 1 in use.
FIG. 2C is a top plan view in schematic of the preferred massage device in use in FIG. 2A.

As illustrated in FIG. 2, the person using the device stands or sits next to a wall, places the device at the desired area between his/her back and the wall, leans onto the massage head-point 4 so as to apply his/her weight against the head 4 and presses against the wall, thereby applying pressure to the desire (treated) spot. The user then rolls the head-point to locate another trigger-point. The person can then relocate the device to another location and repeat the process. When leaned on, the head-point ball applies an acupressure-intense, controlled direct pressure to the tight trigger point. When rolled, the ball provides a smooth rolling massage of sore and tire tissues. Alternatively, the head point can provide a fixed spherical shape, or other shape, without departing from the scope of the invention.

Figure 9:
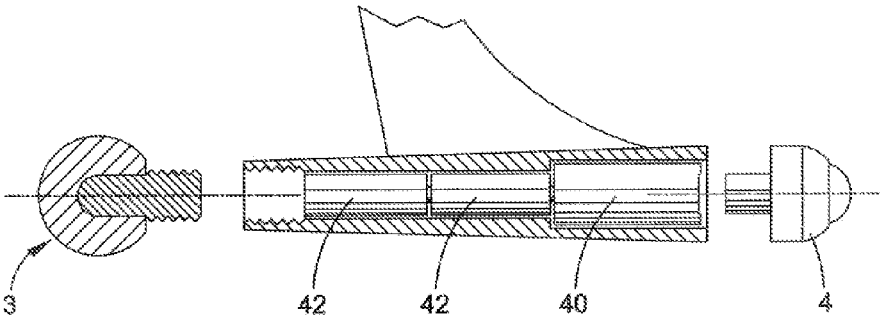
FIG. 9 is a fragmentary ride side elevation view in partial section illustrating another variation of the preferred embodiment of the invention.

FIG. 9 illustrates another variation of the preferred embodiment of the device, wherein at least a portion of the arm 3*a* is tubular, and a vibrating device 40 powered by one or more batteries 42 is housed within the arm 3*a* between a (preferably detachable) rest pivot and a (preferable detachable) head point 4.

While designed to be used as a no strain self massager (leaning against a wall, chair back or other supporting surface), the device can also be used like prior art devices wherein the device is pulled to the place of tension without the aid of a wall or base pivot.

Although the present invention and its advantages have been described in detail, it should be understood that various changes, substitutions and alterations can be made herein without departing from the spirit and scope of the invention as will be defined by appended claims.

I claim:

1. A massage device comprising:

a main body having a body-contacting head point adjacent one end and a manually grippable handle region adjacent the other end, the body shaped to permit a user to reach the back of his/her body with the head point when the handle region is at the user's front or side; and a rest pivot extending away from the main body and terminating at a distal end in a support-contacting face, the rest pivot being positioned with respect to the head point so that when the rest pivot is sandwiched between a support surface and the user with the head point in contact with the user's body and the handle region positioned for contact by the user's hand, (a) the user's bodyweight applied to the rest pivot generally stabilizes the rest pivot against sliding movement on the support surface (b) the user's body weight can be controllably and adjustably applied against the head point by the user, and (c) any pivoting force about the rest pivot applied by the user's hand to the handle region is substantially less than the force exerted against the user's body by the head point.

2. The massage device of claim 1 wherein the main body is generally "J" or "S" shaped.

3. The massage device of claim 1 including a locking mechanism for reversibly bifurcating the main body to allow disassembly for storage or travel.

4. The massage device of claim 3 wherein the main body consists of at least two body segments, the first body segment having a first generally tubular leading end portion with an interior wall, the second body segment having a second generally tubular leading end portion sized to fit within the first generally tubular end portion and further including a cantilevered button carried within the second generally tubular end portion that is positioned to be deflected inwardly by the interior wall of the first generally tubular end portion as the two body segments are fit together, the first generally tubular end portion having a through-hole positioned to overlie said button when the second end portion is inserted into the first end portion, the cantilever providing a spring bias that causes the button to emerge through said hole to thereby releasably lock the two body segments together, until a depressing of the button into the hole thereafter permits the two body segments to be separated.

5. The message device of claim 3 including at least two body segments coupled together for hinged rotation, the locking mechanism including a pair of mechanically interlocking components, a respective one being carried by a respective body segment, the components being positioned on the respective body segments for rotation into sufficient alignment to secure the segments in configuration for use.

6. The massage device of claim 1 wherein the rest pivot includes a generally cup-shaped base having a generally planar or generally concave support-contacting face and an arm pivotably coupling the base to the main body.

7. The massage device of claim 6 including a ball-and-socket coupling between the arm and base.

8. The massage device of claim 6 wherein the cup-shaped base is formed from a resiliently flexible material and the arm is anchored at one end by said material, said material being sufficiently flexible to allow pivoting of the arm as the main body pivots about the base.

9. The massage device of claim 1 wherein the rest pivot includes a base having a support-contacting surface, and a swivel that enables the main body to swivel and turn with respect to the support-contacting surface.

10. The massage device of claim 1 wherein the rest pivot extends from a region of the body substantially opposite the head point.

11. The massage device of claim 1 wherein the rest pivot is generally spherical in shape.

12. The massage device of claim 1 wherein the rest pivot includes a springy helical body coupled to the main body and sufficiently flexible to allow pivoting movement of the main body about the support-contacting surface of the rest pivot.

13. The massage device of claim 12 wherein the springy helical body terminates in the support-contacting surface at its distal end.

14. The massage device of claim 1 wherein the rest pivot is removably attachable to the main body.

15. The massage device of claim 14 wherein the main body has a stem-receiving hole near the head point's position on the body, and the rest pivot comprises a stem having a proximal end portion that fits within said stem-receiving hole and a distal end terminating in the support-contacting surface.

16. The massage device of claim 15 wherein the stem and the main body each carry magnetically-responsive material of which at least one is a magnet to magnetically but detachably secure the rest pivot to the massage device.

17. The massage device of claim 15 wherein the stem and the main body carry mechanically-mating connectors that releasably secure the rest pivot to the massage device.

18. The massage device of claim 17 wherein the stem and main body include interlocking shoulders of a respective male and female connector.

19. The massage device of claim 1 wherein the head point is releasably-secured to the main body.

20. The massage device of claim 1 wherein the head point is detachably coupled to the device.

21. The massage device of claim 20 wherein the head point includes a rollable ball for rolling contact against the user.

22. The massage device of claim 1 wherein the head point includes a rollable ball for rolling contact against the user.

23. The massage device of claim 1 wherein the rest pivot comprises a material sufficiently flexible to pivotably couple the main body to the support surface when the user's bodyweight is applied to the rest pivot to generally stabilize the rest pivot against the support surface.

24. A massage device comprising:

a main body having a body-contacting head point adjacent one end and a manually grippable handle region adjacent the other end, the body shaped to permit a user to reach the back of his/her body with the head point when the handle region is at the user's front or side; and a rest pivot extending away from the main body and terminating at a distal end in a support-contacting face, the rest pivot being positioned with respect to the head point so that when the massage device is sandwiched between a support surface and the user with the head point in contact with the user's body and the handle region positioned for contact by the user's hand, (a) the user's bodyweight applied to the rest pivot generally stabilizes the rest pivot against sliding movement on the support surface and (b) any pivoting force about the rest pivot applied by the user's hand to the handle region is substantially less than the force exerted against the user's body by the head point, the rest pivot including a generally cup-shaped base and an arm pivotably coupling the base to the main body, and having a ball-and-socket coupling between the arm and base.

25. A massage device comprising:

a main body having a body-contacting head point adjacent one end and a manually grippable handle region adjacent the other end, the body shaped to permit a user to reach the back of his/her body with the head point when the handle region is at the user's front or side; and a rest pivot extending away from the main body and terminating at a distal end in a support-contacting face, the rest pivot being positioned with respect to the head point so that when the massage device is sandwiched between a support surface and the user with the head point in contact with the user's body and the handle region positioned for contact by the user's hand, (a) the user's bodyweight applied to the rest pivot generally stabilizes the rest pivot against sliding movement on the support surface and (b) any pivoting force about the rest pivot applied by the user's hand to the handle region is substantially less than the force exerted against the user's body by the head point, wherein the rest pivot includes a springy helical body coupled to the main body and sufficiently flexible to allow pivoting movement of the main body about the support-contacting surface of the rest pivot.

26. The massage device of claim 24 wherein the springy helical body terminates in the support-contacting surface at its distal end.

* * * * *